United States Patent [19]

Orlita

[11] Patent Number: 4,708,605

[45] Date of Patent: Nov. 24, 1987

[54] PISTON PUMP WITH ROTATING PISTON HAVING A UNIVERSAL JOINT

[76] Inventor: Franz Orlita, Waldstrasse 33, D-6305 Buseck-Alten Buseck, Fed. Rep. of Germany

[21] Appl. No.: 870,127

[22] Filed: Jun. 2, 1986

[30] Foreign Application Priority Data

Jun. 5, 1985 [DE] Fed. Rep. of Germany ..... 3520233

[51] Int. Cl.[4] ..... F04B 7/06

[52] U.S. Cl. ..... 417/500; 464/106; 464/150

[58] Field of Search ..... 417/500, 492; 464/106, 464/147, 150, 151, 155

[56] References Cited

U.S. PATENT DOCUMENTS

| | | | |
|---|---|---|---|
| 2,921,451 | 1/1960 | Helmke | 464/106 |
| 3,168,872 | 2/1965 | Pinkerton | 417/492 |
| 4,008,003 | 2/1977 | Pinkerton | 417/492 X |
| 4,531,897 | 7/1985 | Orlita | 417/500 |

FOREIGN PATENT DOCUMENTS

| | | |
|---|---|---|
| 0116165 | 8/1984 | European Pat. Off. . |
| 509222 | 9/1930 | Fed. Rep. of Germany . |

*Primary Examiner*—Leonard E. Smith
*Assistant Examiner*—Eugene L. Suzecina, Jr.
*Attorney, Agent, or Firm*—Flynn, Thiel, Boutell & Tanis

[57] ABSTRACT

Both the rotating drive and also the back and forth movement of the pump piston (5) occurs through a joint arrangement (29), which consists of a first through (65) on the crank (28), a second trough (67) on the piston (5) and a rolling member (30) which is received in the troughs (65, 67). The troughs are pressed by a springy ring (68) against the rolling member (30). The troughs (65, 67) have a slightly smaller curvature than the rolling member (30), so that the rolling member (30) rolls in the troughs (65, 67). Friction in the joint arrangement (29) is avoided through this, which results in a long life of the joint arrangement (29).

11 Claims, 8 Drawing Figures

PISTON PUMP WITH ROTATING PISTON HAVING A UNIVERSAL JOINT

FIELD OF THE INVENTION

The invention relates to a piston pump comprising a rotating piston which is movable back and forth in a cylinder bore and comprising a rotating crank, to which the piston is hingedly connected, whereby the piston axis and the axis of rotation of the crank intersect one another and crank and piston are drivably coupled with one another and whereby the joint has rolling surfaces provided on the crank and on the piston.

BACKGROUND OF THE INVENTION

Pumps with a rotatable piston have the advantage that they can be constructed as control piston pumps, in which the piston acts as a rotary slide valve. Such pumps have a minimum of movable parts and are extremely robust. In order to assure the rotary slide valve function, the joint between crank and piston must be constructed such that angle changes are possible, however, the piston is rotated safely and as much as possible clearance-free. Thus, special demands on the joint are made.

In a known pump (German Pat. No. 509 222), the crank is connected to the piston through a ball-and-socket joint. The ball-and-socket joint is susceptible to wear because of the constant sliding movements between ball and ball socket, which can quickly result in clearance in the ball-and-socket joint. This results in noise development and also in changes of the conveying characteristic. Therefore, either a good lubrication must be provided or, however, a short life must be accepted.

Known are also pumps of the abovementioned type (EP OS No. 0 116 165), in which sliding movements are substantially avoided in the jointed connection between crank and piston, which results in a long life. One of the solutions described in the known reference has a conical surface rolling on a flat surface. It is true that one thereby obtains favorable pressure conditions between the rolling surfaces, however, only at a specific angle of inclination. Thus, the conveying stroke of said pump cannot be changed simply by changing the inclination of the axes. EP OS No. 0 116 165 also describes a solution (FIGS. 4,5 of this reference), which permits a change of the inclination. One rolling surface is thereby constructed as a torus the other one as a groove, into which the toric surface extends. A spring is provided for transmitting the forces during the suction stroke, which spring presses the toric rolling surface into the groove. The pressure conditions are not particularly favorable, since for structural reasons the cross section of the torus is small. Also it is not possible to transmit the forces occurring during the suction stroke through the rolling surfaces.

The basic purpose of the invention is to construct a piston pump of the abovementioned type such that the angle between the piston axis and the crank axis can be adjusted for the purpose of changing the conveying stroke and that at all adjusted positions favorable pressure conditions exist. The pump is also supposed to be able to be designed such that the forces occurring during the suction stroke can also be transmitted through the rolling surfaces.

This purpose is attained according to the invention by the rolling surfaces on crank and piston being constructed as troughs and by a convex rolling member being received in the troughs, the surface curvature of which rolling member is greater than the curvature of the trough surface, whereby the edges of the troughs are oriented such that during all relative positions between the troughs, the trough edges do not contact one another and a form-closed engagement between troughs and rolling member exists in peripheral direction of the rotating movement and forces can be transmitted through the rolling member in direction of the pressure stroke.

In contrast to the known pumps of the abovementioned type, the subject matter of the invention does not have rolling surfaces roll directly on the piston and rolling surfaces directly in the crank, but an additional loose rolling member is provided. The pressure relationships do not change in such a basic construction during adjustments of the angle between crank axis and piston axis, so that a change of the inclination can be provided. The pump is, however, also advantageous if an adjustment is not provided, since the rolling member and the troughs can be easily manufactured. Because of the difference in the curvature of rolling member and trough surfaces, the rolling member carries out a rolling movement simultaneously in both troughs, whereby sliding friction is avoided. The pressure conditions are advantageous in all adjustments. Since the curvatures of the trough surfaces and the curvature of the rolling member can come very close, the Hertz pressure is relatively small, which results in a long life of the joint even at poor lubrication.

The edges of the troughs are advantageously oriented such that a form-closed engagement between troughs and rolling member also exists in direction of the suction stroke, so that tension forces can also be transmitted from the crank onto the piston. Such a design has the advantage that a spring is not needed for overcoming the suction forces. The invention can, however, also be designed with an orientation of the troughs which does not permit the transmission of forces during the suction stroke. In this case it is necessary, just like in the known pump of the abovementioned type, to provide a spring which receives the forces occurring during the suction stroke.

The troughs are constructed preferably elongated and are oriented transversely to their paths of movement. The difference between the width of the circular crank path and the small axis of the ellipse, along which the trough which is provided on the piston moves, is bridged with such elongated troughs. An elongated construction of the troughs is not needed when the angle between crank axis and piston axis is small, since the difference between the diameter of the crank path and the length of the small axis of the ellipse is very small. An elongated construction of the troughs is also not needed in the yet to be explained tangential arrangement of the troughs.

The rolling member is preferably a ball. A ball-shaped rolling member can be particularly easily manufactured. Balls with good physical properties can be obtained in commerce. Well suited are balls, as they are also used in ball bearings. Shapes differing from a ball shape are possible. For example a disk-shaped rolling member can be considered.

According to a further development of the invention a preferably elastic clamp element is provided in order to hold the trough members containing the troughs against the rolling member. This prevents with certainty that the troughs lift off from the rolling member. However, a clamp element is not needed in every case. A clamp element, however, is needed when a form-closed engagement is not provided for the transmission of the suction stroke forces. In place of a clamp element, it is also possible to provide a special support between crank and piston, which is spaced from the piston axis and serves to transmit a negative torque, as it may possibly occur during the suction stroke.

If the angle between crank axis and piston axis is supposed to be changeable, a construction is particularly advantageous. Whereby by rotating a cylinder member containing the cylinder bore, the angle of inclination can be changed and be moved to the value zero, if the angles are chosen for example such that the angle between the axis of the cylinder bore and the axis of the cylinder member is of the same size as the angle between the axis of the cylinder member and the axis of the crank. A conveying does not take place any longer in this position.

BRIEF DESCRIPTION OF THE DRAWINGS

Exemplary embodiments of the invention are illustrated in the drawings, in which.

DETAILED DESCRIPTION

Figure 1:
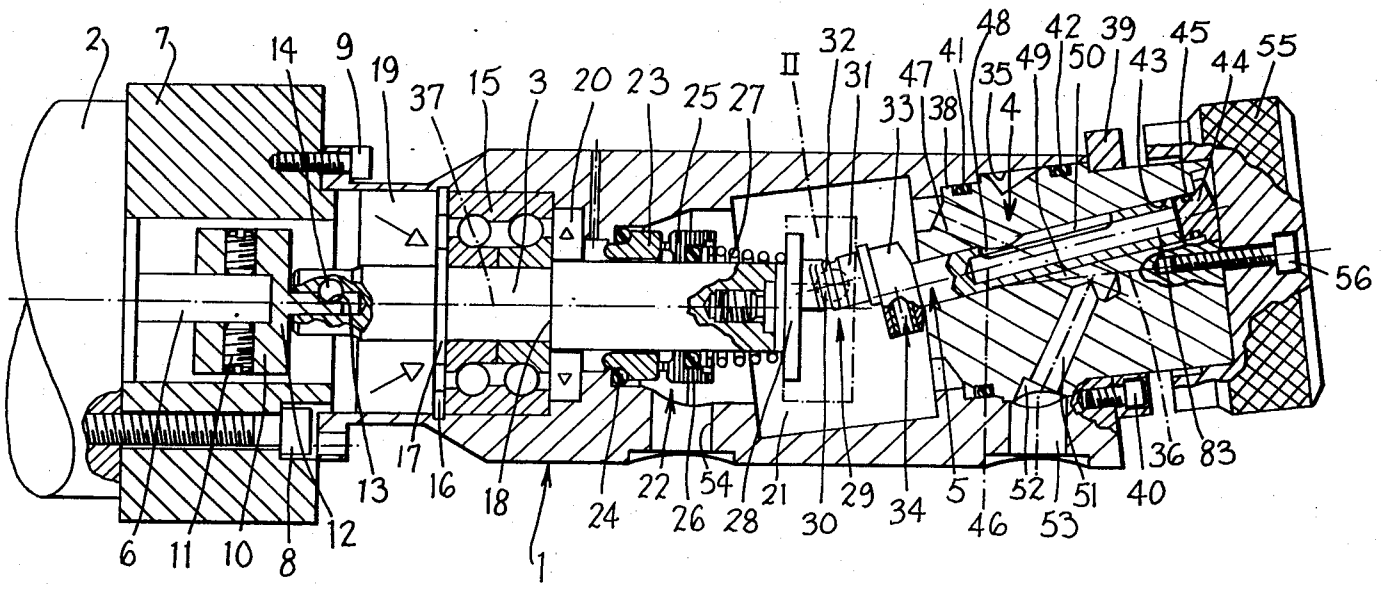
FIG. 1 is a diametrical longitudinal cross-sectional view of a pump.

The pump has a housing 1, a driving motor 2, a pump shaft 3, a cylinder member 4 and a piston 5.

The driving motor 2 is an electric motor, which is only partially illustrated and from the housing of which projects one end of the motor shaft 6. An intermediate ring 7 is connected to the motor 2 by means of screws 8. A pump housing 1 is in turn connected to the intermediate ring 7 by means of screws 9. A coupling piece 10 is mounted on the motor shaft 6, which coupling piece is clamped to the shaft 6 by means of screws 11. The coupling piece 10 has a cylindrical shoulder 12, on which a carrier surface 13 is provided. A pin 14 rests on the carrier surface 13, which pin is placed through a bore in the pump shaft 3.

The pump shaft 3 is supported in the pump housing 1 by means of a ball bearing 15, which is axially secured by means of a snap ring 16. A snap ring 17 and a shoulder 18 are provided on the pump shaft to axially fix the ball bearing. The bearing is sealed off toward the motor 2 by means of a shaft packing 19 and toward the inside of the pump housing 1 by means of a shaft packing 20.

To seal off the chamber 21 within the pump housing 1 to the left, a seal arrangement which as a whole is identified by the reference numeral 22 is used. Part of the arrangement 22 is a slide ring 23, which engages through an elastic O-ring seal 24 a shoulder in the pump housing. A gasket ring 25, which is sealed off with respect to the pump shaft 3 by an elastic O-ring seal 26, slides on the slide ring 23. A compression spring 27 presses onto the gasket ring 25, which compression spring 27 is supported with its right end on a structural part 28. The structural part 28 is supposed to be identified as a crank because of its function which will yet be explained. A joint arrangement which as a whole is identified with reference numeral 29 is provided between the crank 28 and the piston 5. This joint arrangement is the subject matter of the invention in a more narrow sense. The crank 28 which has already been mentioned, a ball 30, a trough member 31 and a spring ring 32 are part of the joint arrangement. The trough member 31 is inserted into a head 33 of the piston 5 and is secured by means of a threaded pin 34.

The cylinder member 4 is received in a sloped bore 35 of the pump housing 1. The axis 36 of said bore, which coincides with the axis of the cylinder member 4, is inclined with respect to the axis 37 of the pump shaft 3. The axes 36 and 37 intersect. The cylinder member 4 is secured in axial direction to the left by resting on a shoulder 38 of the pump housing and to the right by a ring 39, which is screwed onto the pump housing by means of screws 40. The chamber 21 is sealed off to the right by two gasket rings 41, 42.

A bore 43 is provided in the cylinder member 4. The piston 5 can slide in said bore 43. The bore 43 is sealed off to the right by a plug 44 which is partially received in the cylinder bore 43 and has an annular groove on the part in the bore 43 for receiving a gasket 45. The cylinder bore 43 is smooth. The axis 46 of the cylinder bore 43, which coincides with the axis of the piston 5, is inclined with respect to the axis 36 of the cylinder member. The angle between the axes 36 and 46 is of the same size as the angle between the axes 36 and 37.

A bore 47, which cuts through the cylinder bore 43, is provided in the cylinder member 4. The inlet point forms a suction opening 48 and the outlet point a pressure opening 49. A longitudinal slot 50 is provided in the piston, which slot can be congruent both with the suction opening 48 and also with the pressure opening 49. The pressure opening 49 communicates through a bore 51 with a groove 52, which extends over the circumference of the cylinder member 4. The groove 52 communicates during each rotated position of the cylinder member 4 with a connecting bore 53, to which a pressure line can be connected. The suction opening 48 communicates with the chamber 21, into which ends a connecting bore 54 for a suction line.

An adjusting ring 55 is mounted on the cylinder member 4 and is axially secured by means of a screw 56. The adjusting ring 55 permits in a convenient manner a rotating of the cylinder member 4.

The joint arrangement 29 will be described in detail hereinafter in connection with the further drawings.

Figure 8:
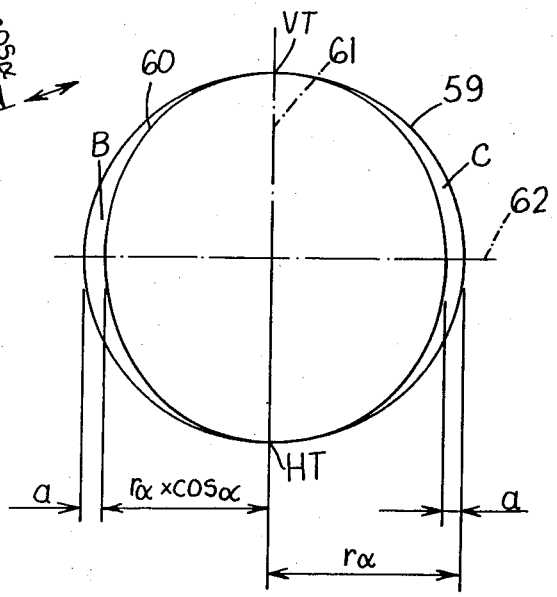
FIGS. 7, 8 are schematic illustrations to explain the geometric relationships.
Figure 7:
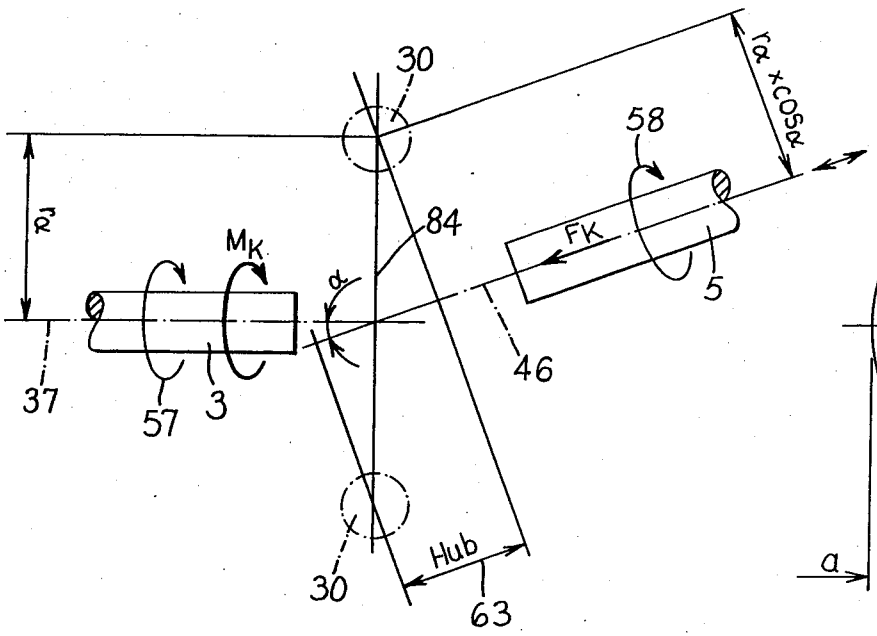

The geometric relationships will be viewed first in connection with FIGS. 7 and 8. FIG. 7 schematically illustrates the pump shaft 3 and the piston 5. Only the ball 30 of the joint arrangement is illustrated in two different positions. The piston axis 46 intersects the axis 37 of the pump shaft 3. The angle is identified with $\alpha$. The joint rotates about the axis 37 on a circular path with the radius $r_\alpha$. The piston 5 rotates in the same direction as the pump shaft 3. The direction of rotation is indicated by arrows 57, 58. The shaft 3 can be driven with a torque $M_K$. The piston is also rotated through the joint arrangement namely with the same speed as the pump shaft 3. An axial force $F_K$ acts onto the piston, which axial force is symbolized by an arrow in FIG. 7. The part of the joint arrangement 29, which is connected fixedly to the pump shaft 3 moves on a circular path. The circular path is illustrated in FIG. 8 and is identified by the reference numeral 59. The part of the joint arrangement which is connected to the piston describes an elliptical path 60 in the plane defined by the line 84, the large axis 61 of which plane has a length of $2 \cdot r_\alpha$. The small ellipse axis has a length of $2 \cdot r_\alpha \cdot \cos\alpha$. From this results that the difference a on each side has the value $r_\alpha - r_\alpha \cdot \cos\alpha$, thus $r_\alpha \cdot (1-\cos\alpha)$. The entire difference in the width of the path 59 and 60 is thus $2 \cdot r_\alpha (1-\cos\alpha)$. The ellipse 60 can also be viewed as a diagonal cross section of a cylinder jacket, which has a radius of $r_\alpha \cdot \cos\alpha$.

The piston stroke at the illustrated angle $\alpha$ is characterized in the drawing by the measurement line 63. It can easily be seen from FIG. 7, that the stroke changes in dependency of the angle $\alpha$. The stroke becomes smaller and smaller with the angle $\alpha$ becoming smaller. When $\alpha$ has the value zero, the piston 5 is only rotated, however, is no longer moved back and forth. The conveying is then zero. The difference between the paths 59 and 60 requires a particular design of the joint, which will yet be explained in detail.

Figure 2:
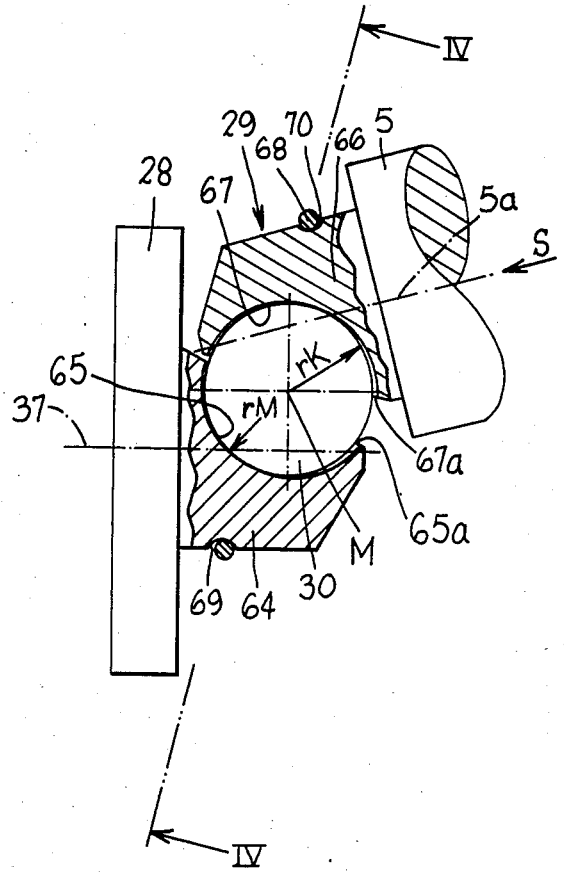
FIG. 2 illustrates an enlarged section of FIG. 1 in the area of the dash-dotted frame II during a tangential position of the troughs.

FIG. 2 is an enlarged illustration of the joint arrangement 29. The crank 28 is rotatable about the axis 37. A trough member 64 is provided on the structural part 28, into which trough member is machined a trough 65 which receives therein the ball 30. A further trough member 66 is provided on the piston 5, which further trough member 66 has a trough 67 therein and which has the same shape as the trough 65. The trough members 64 and 66 are pressed against the ball 30 by a spring ring 68 which is cut open. Grooves 69, 70 are provided for this purpose on the outer sides of the trough members 64, 66. The spring ring 68 is received in said grooves.

Figure 5:
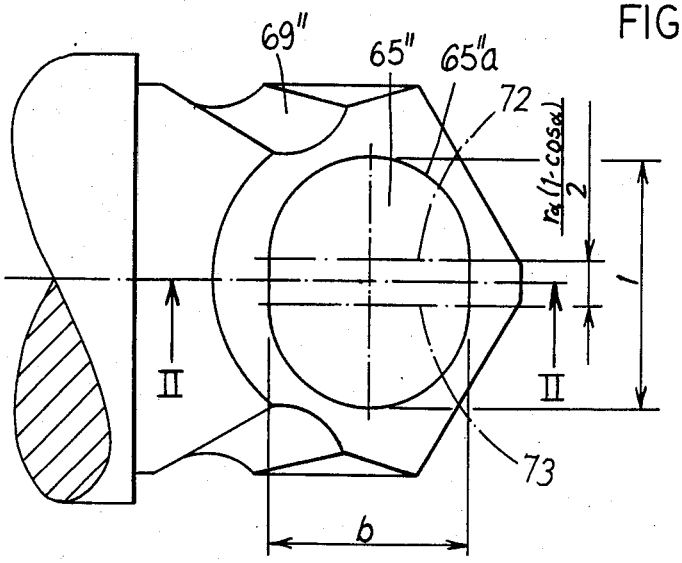
FIG. 5 is a top view of a trough member corresponding with the line V—V of FIG. 6.
Figure 6:
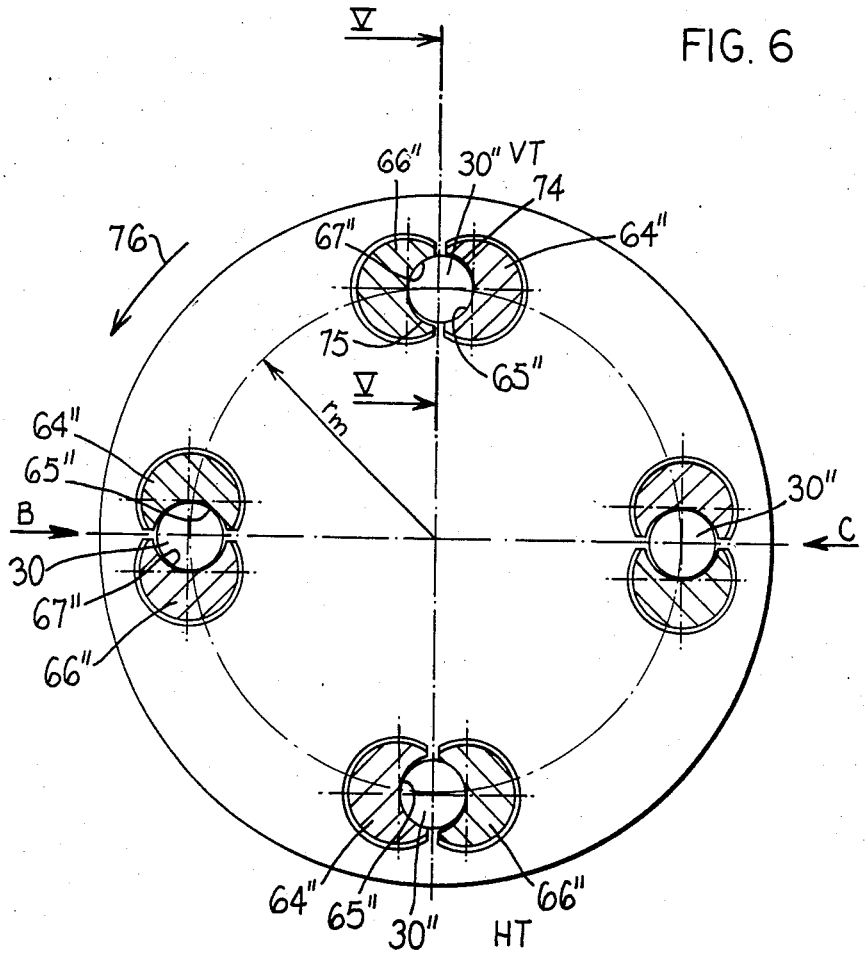
FIG. 6 shows several cross sections, approximately corresponding with FIG. 4, during various rotated positions of the pump.

FIG. 5 is a top view of the trough 65'' of FIG. 6. The length 1 of the trough 65'' is greater than the width b of the trough namely at least by the amount $\frac{1}{2} \cdot r_\alpha \cdot (1-\cos\alpha)$. In the cross section along the line II—II of FIG. 5, the radius $r_M$. of the trough (shown in FIG. 2) is only slightly larger than the radius $r_K$ of the ball 30'', however, at any rate larger than the ball radius $r_K$, so that the ball can carry out a rolling motion in the trough. The trough cross section parallel to the longitudinal direction of the trough consists in the area of the dash-dotted lines 72 and 73 of a short straight piece, the length of which is at least $\frac{1}{2} \cdot r_\alpha \cdot (1-\cos\alpha)$. The straight piece is followed by radii having a radius $r_M$. The trough has the shape of a groove with a circular cross section in the area between the lines 72, 73, whereby the radius of the circle is only a little larger than the radius of the ball. The longitudinal direction of the troughs must be oriented such that they can compensate for the difference a (see FIG. 8) between the circular path and elliptical path, thus substantially radially with respect to the axes of the crank and the piston.

When the pump operates, the ball 30 carries out a rolling motion in the two troughs 65, 67, whereby it rolls simultaneously in the trough 65 and in the trough 67. During one operating cycle, consisting of a suction stroke and a pressure stroke, the rolling member 30 rolls within the two troughs 65, 67. The rolling motion is favored by the reversal of the force direction during the transition from suction stroke to pressure stroke. Important for the rolling is that the curvatures in the troughs 65, 67 are also slightly smaller than the curvature of the ball surface. The difference transversely to the longitudinal direction of the troughs is very small and is illustrated very exaggerated in FIG. 2. Since the curvatures in peripheral direction are only little different, there exists insignificant clearance with respect to the rotating drive of the piston. Certain clearance exists transversely with respect to the direction of rotation in order that the trough 67 on the piston describes an elliptical path. The difference between the elliptical path 60 and the circular path 59 (see FIG. 8) is caught half in the trough 65 and half in the trough 67. The ball 30 carries out a small back and forth movement relative to the troughs during one rotation of the pump shaft 3.

The edges **65*a* and 67*a* of the troughs 65, 67 lie each on a plane and are spaced from one another such that they do not collide with one another during the possible relative positions between the trough members 64, 66. When the trough edges 65*a*, 67*a* which have the shape seen in FIG. 5, are positioned parallel to one another, they have the same distance from an equator of the ball 30, which equator is parallel to the trough edges, that is, they form approximately parallels of latitude of the ball 30. Of course the trough edges 65*a*, 67*a* do not exactly have a circular shape, but are constructed slightly elongated (see FIG. 5). Of course, the elongation is shown exaggerated in FIG. 5**.

FIG. 6 illustrates various situations in the joint arrangement during one full rotation of pump shaft 3 and piston 5. The piston 5 has finished its conveying stroke in the front dead center, which is identified with VT in FIG. 6. The piston is moved as far as possible into the cylinder bore. The ball 30'' lies in this situation at the inner end of the elongated trough 65'' and at the outer end of the trough 67''. This is illustrated by the spaces 74, 75 in the drawing. Thus, the trough lengths are utilized fully. The paths of movement 59, 60 coincide in the front dead center VT.

After one 90° rotation of the pump shaft 37 in direction of the arrow 76, the position identified with B in FIG. 6 is reached. The ball 30'' now lies in the longitudinal center of the troughs 65'', 67''. After a further rotation to the rear dead center (identified with HT in FIGS. 6 and 8), the ball 30'' rests again at the ends of the troughs, namely at the trough ends which are opposite those where the ball had rested in the front dead center (VT). The ball 30'' had rested in the front dead center at the inner end of the trough 65'', while it rests in the rear dead center at the outer end of the trough 65''. The ball 30'' rests accordingly in the front dead center (VT) at the outer end of the trough and in the rear dead center at the inner end of the trough. After a further 90° rotation the position C is reached, in which the ball 30'' lies again in the longitudinal centers of the troughs. The deviation of the elliptical path 60 from the circular path 59 is met by the elongated construction of the troughs.

It is possible in the described exemplary embodiment to transmit through the ball 30 also forces onto the piston 5 which are created during the suction stroke. As is clearly shown in FIG. 2, the ball 30 is received in the troughs 65, 67 such that a form-closed engagement exists also in direction of the suction stroke S (see FIG. 2), which form-closed engagement is secured in addition by the spring ring 68. The plane of the spring ring 68 goes approximately through the centerpoint M of the ball 30.

Figure 3:
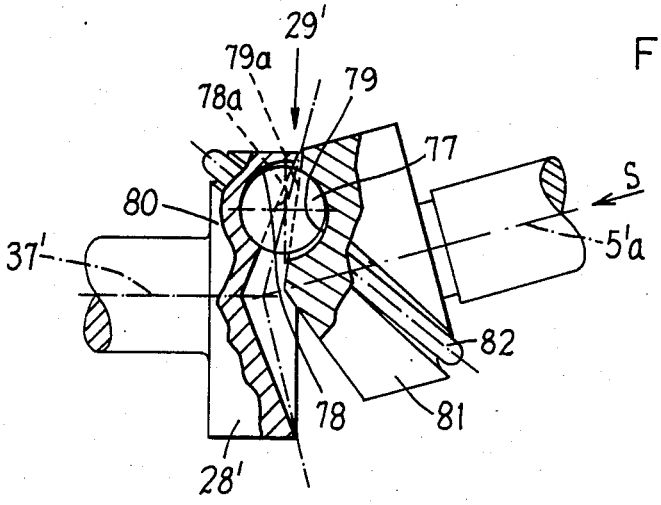
FIG. 3 illustrates a detail corresponding with FIG. 2 of a different embodiment of the invention.

The ball 77 is received in the troughs 78, 79 in the embodiment of FIG. 3, which troughs are oriented differently than the troughs 65, 67. Also the troughs 78, 79 are constructed elongated in order to be able to bridge the difference between the circular path of the crank 80 and the elliptical path of the piston 81. However, the ball is unable to transmit forces, with which the piston can be pulled in direction of the suction stroke S. FIG. 3 shows this clearly. A suction stroke is, however, still possible because of a spring ring 82, which presses the troughs 78, 79 on the ball 77. The hereby occurring forces must be taken over by the spring ring 82. The embodiment according to FIG. 3 has the advantage that particularly favorable conditions exist for the pressure stroke.

FIG. 2 illustrates an embodiment in which the edge 65*a* of the trough 65 lies in a plane which is tangent to an imaginary cone around the crank axis 37 along a cone line. The planes, in which lie the trough edges 65*a*, 67*a*, can, however, also be oriented differently, for example such that they contact imaginary cylinders around the axes 37 and 5*a*. A spring ring 68 and an elongated construction of the troughs is not needed in these cases.

FIG. 3 shows a "tangential position," which in principle corresponds with FIG. 2, whereby, however, the imaginary cones around the crank axis 37′ or the piston axis 5′*a* are substantially more truncated (larger cone angle) than in the embodiment according to FIG. 2. A spring ring 82 is here sensible because of the very truncated cone angle.

Figure 4:
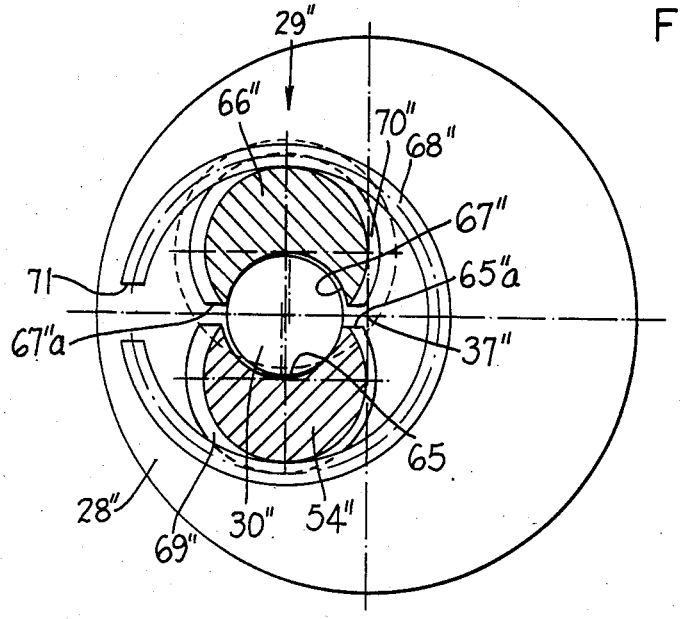
FIG. 4 is a cross-sectional view along the line IV—IV of FIG. 2, whereby, however, in comparison with FIG. 2. The joint between the crank and the piston is rotated 90° in a radial position.

FIG. 4 identifies parts, which are analogous with parts of FIG. 2, with the same reference numerals which, however, in order to differentiate with respect to parts according to FIG. 2 each have two index primes (″). In the extreme position illustrated in FIG. 4, the edge 65″*a* of the trough 65″ of the trough member 64″ lies in a plane which is parallel to a plane, which extends through the axis 37″ of the crank 28″. The edge 67″*a* of the trough 67″ of the trough member 66″ lies in one plane, which is parallel to a plane, which extends through the piston axis. A ring 68″ is needed in this extreme position in order to keep during a negative torque the trough members 64″, 66″ in contact with the rolling member 30″.

Any desired in between arrangements are possible between the so to speak "tangential arrangements" according to FIGS. 2 and 3 and the so to speak "radial arrangement" according to FIG. 4, in which the planes in which lie the trough edges can differ in all directions from the illustrated positions.

OPERATION

The pumps operate as follows. Upon rotation of the motor shaft 6, the pump shaft 3 is carried along by the coupling piece 10. Thus also the crank 28 is rotated and carries the piston 5 along through the ball 30. FIG. 1 illustrates the front dead center of the piston, in which the groove 50 of the piston communicates with the suction opening 48. Upon further rotation, the piston is pulled back and reaches through the position B finally the rear dead center HT, whereby the cylinder chamber is filled with conveying medium through the bore 47, the longitudinal slot 50 and a bore 83 within the piston 5. After exceeding the rear dead center HT, the chamber within the cylinder bore 43 is again reduced and the conveying medium reaches through the longitudinal slot 50, the bore 51 and the connecting bore 53. The slot 50 communicates with the pressure opening 49 during the pressure stroke.

A rotated position of the cylinder member 4 is illustrated, in which the angle $\alpha$ between the axis 37 of the pump shaft and the axis 46 of the piston is the largest. The angle can be reduced by rotating the cylinder member 4 and can finally be reduced to zero. This parallel alignment is possible, since the angle between the axes 36 and 46 equals the angle between the axes 36 and 37.

Embodiments with elastic, cut-open rings 68 and 82 are illustrated. However, it is also possible to use closed rings. Such rings can be stressed substantially more with respect to tension.

The invention has been described in connection with one example, in which the rolling member 30 is constructed as a ball. However, it is also possible to use a rolling member which has a shape, differing from a ball, of a convex surface, for example a disk.

The embodiments of the invention in which an exclusive property or privilege is claimed are defined as follows:

1. In a piston pump comprising a rotating piston, which is movable back and forth in a cylinder bore, and comprising a rotating crank, to which said piston is connected hingedly, whereby a piston axis and an axis of rotation of said crank intersect one another and said crank and said piston are coupled drivably with one another and wherein a joint has rolling surfaces, which are provided on said crank and on said piston, the improvement comprising wherein said rolling surfaces on said crank and said piston are constructed as troughs and wherein a convex rolling member is received in said troughs, said rolling member having a surface curvature which is greater than the curvature of the trough surfaces, whereby the edges of said troughs are oriented such that during all relative positions between said troughs, the trough edges do not contact one another and in peripheral direction of the rotating movement there exists a form-closed engagement between said troughs and said rolling member and forces can be transmitted through said rolling member in direction of the pressure stroke.

2. A piston pump according to claim 1, wherein said edges of said troughs are oriented such that a form-closed engagement between said troughs and said rolling member exists also in direction of the suction stroke, so that tension forces can be transmitted from said crank to said piston.

3. A piston pump according to claim 1, wherein said troughs are elongated transversely to their paths of movement, wherein the dimensions of said troughs in their longitudinal direction are greater at least by the amount $\frac{1}{2}\cdot r\cdot(1-\cos\alpha)$ than a dimension of said troughs transversely to their longitudinal direction, wherein r is the crank radius and $\alpha$ the angle between the piston axis and the axis of rotation of the crank.

4. A piston pump according to claim 1, wherein said rolling member is a ball and said troughs have circular cross sections at least in cross sections tangentially to the direction of rotation.

5. A piston pump according to claim 1 including an elastic clamp element which grips around said trough members containing said troughs and presses said troughs elastically against said rolling member.

6. A piston pump according to claim 5, wherein said clamp element is constructed as an elastically expandable cut-open ring.

7. A piston pump according to claim 6, wherein said cut-open ring is received in grooves on said trough members and thus its position transversely to its plane is fixed.

8. A piston pump according to claim 6 wherein said cut-open plane of the ring extends at least approximately through the centerpoint of the rolling member.

9. A piston pump according to claim 1, wherein said piston and pump shaft includes means for facilitating a relative adjustment to one another so that the angle ($\alpha$) between said axis of rotation of said crank and said piston axis can be changed.

10. A piston pump according to claim 9, wherein said cylinder bore is in a rotatable cylinder member, which is supported in a pump housing, whereby the axis of said cylinder member lies inclined with respect to the axis of said crank and said axis of said cylinder bore inclined with respect to the axis of rotation of said cylinder member.

11. A piston pump according to claim 10, wherein the angle between the axis of said cylinder bore and the axis of said cylinder member is of the same size as the angle between the axis of said cylinder member and the axis of said crank.

* * * * *

UNITED STATES PATENT AND TRADEMARK OFFICE

CERTIFICATE OF CORRECTION

PATENT NO. : 4 708 605

DATED : November 24, 1987

INVENTOR(S) : Franz ORLITA

It is certified that error appears in the above-identified patent and that said Letters Patent is hereby corrected as shown below:

Column 9, line 8-9; change "said cut-open plane of the ring" to ---the plane of said cut-open ring---.

Signed and Sealed this

Thirty-first Day of May, 1988

*Attest:*

*Attesting Officer*

DONALD J. QUIGG

*Commissioner of Patents and Trademarks*